United States Patent [19]

Ferrari et al.

[11] Patent Number: 5,025,530

[45] Date of Patent: Jun. 25, 1991

[54] QUICK COUPLING DOOR HINGE

[75] Inventors: Franco Ferrari, Frazione Deviscio, 1, 22053 Lecco (Como); Carlo Migli, Lecco, both of Italy

[73] Assignee: Franco Ferrari, Lecco, Italy

[21] Appl. No.: 434,319

[22] Filed: Nov. 13, 1989

[30] Foreign Application Priority Data

| | | | |
|---|---|---|---|
| Nov. 16, 1988 | [IT] | Italy | 22155 B/88 |
| Jan. 4, 1989 | [IT] | Italy | 20408/89 [U] |
| Aug. 25, 1989 | [IT] | Italy | 21626/89[U] |

[51] Int. Cl.[5] ..... E05D 7/10

[52] U.S. Cl. ..... 16/236; 16/240; 16/258; 16/382; 16/DIG. 43

[58] Field of Search ..... 16/227, 237, 240, 246, 16/258, 259, 267–269, 324, 327, 333, 349, 370, 382, DIG. 43, 238

[56] References Cited

U.S. PATENT DOCUMENTS

| | | | |
|---|---|---|---|
| 4,654,932 | 4/1987 | Rock et al. | 16/382 |
| 4,691,408 | 9/1987 | Rock et al. | 16/246 |
| 4,800,622 | 1/1989 | Rock et al. | 16/246 |
| 4,888,853 | 12/1989 | Rock et al. | 16/246 |

FOREIGN PATENT DOCUMENTS

| | | | |
|---|---|---|---|
| 255692 | 2/1988 | European Pat. Off. | 16/227 |
| 256376 | 2/1988 | European Pat. Off. | 16/227 |
| 2837327 | 3/1980 | Fed. Rep. of Germany | 16/237 |

*Primary Examiner*—Richard K. Seidel
*Assistant Examiner*—Edward A. Brown
*Attorney, Agent, or Firm*—Finnegan, Henderson, Farabow, Garrett & Dunner

[57] ABSTRACT

A hinge, in particular for furniture doors, of the type in which a wing is designed to be fitted to a base secured to the piece of furniture, comprises an intermediate element for connecting the wing to the base having a substantially U-shaped transverse configuration to determine two rigid sides which laterally embrace the base.

The intermediate element is provided with fastening means for securing it to the wing, and unfastenable means connecting it to the base comprising members yieldingly fitted onto the intermediate element in two portions spaced apart from each other in the longitudinal direction of the wing. The yielding members are elastically biased to move into a position in which they engage with complementary housings in the base in order to couple the intermediate element to the latter, the movement of approach between the base and the wing for the coupling being amply indeterminate.

19 Claims, 8 Drawing Sheets

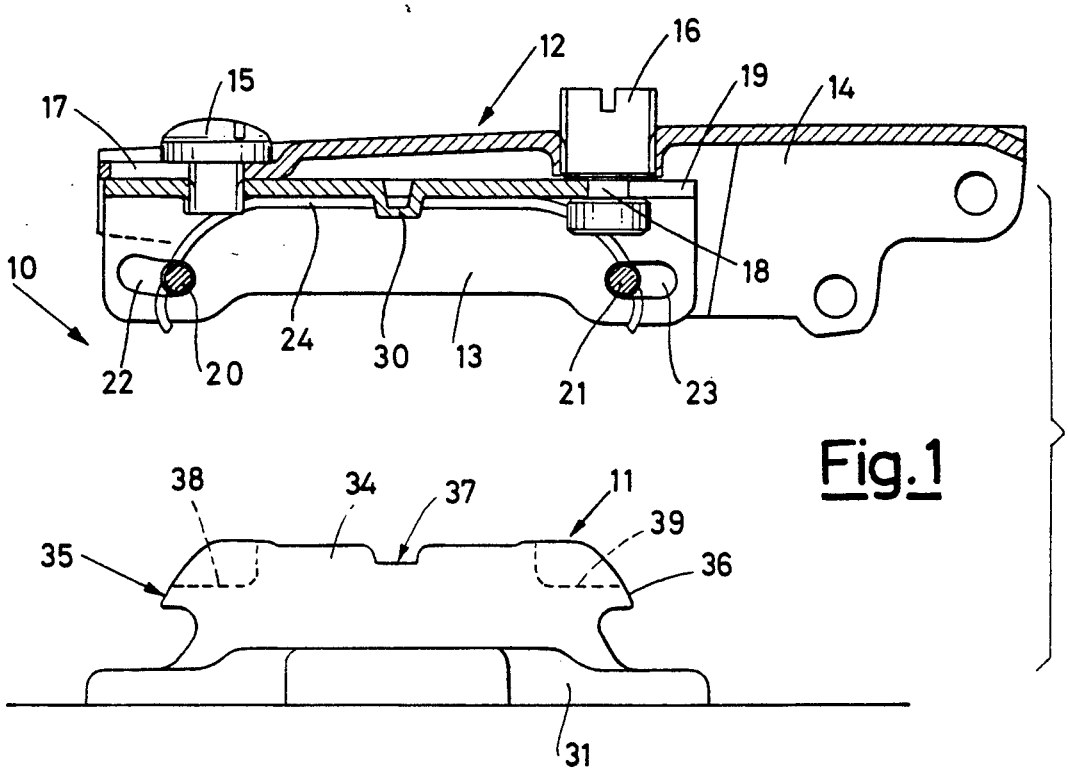
Fig.1
Fig.2
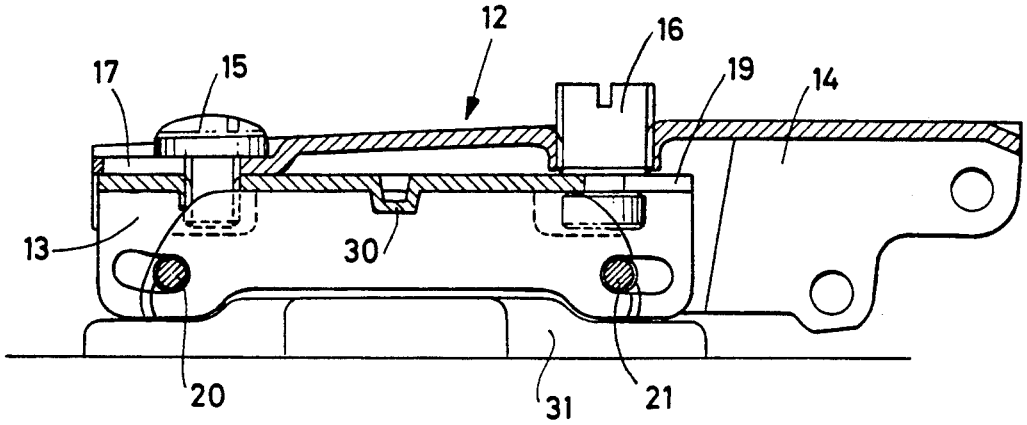

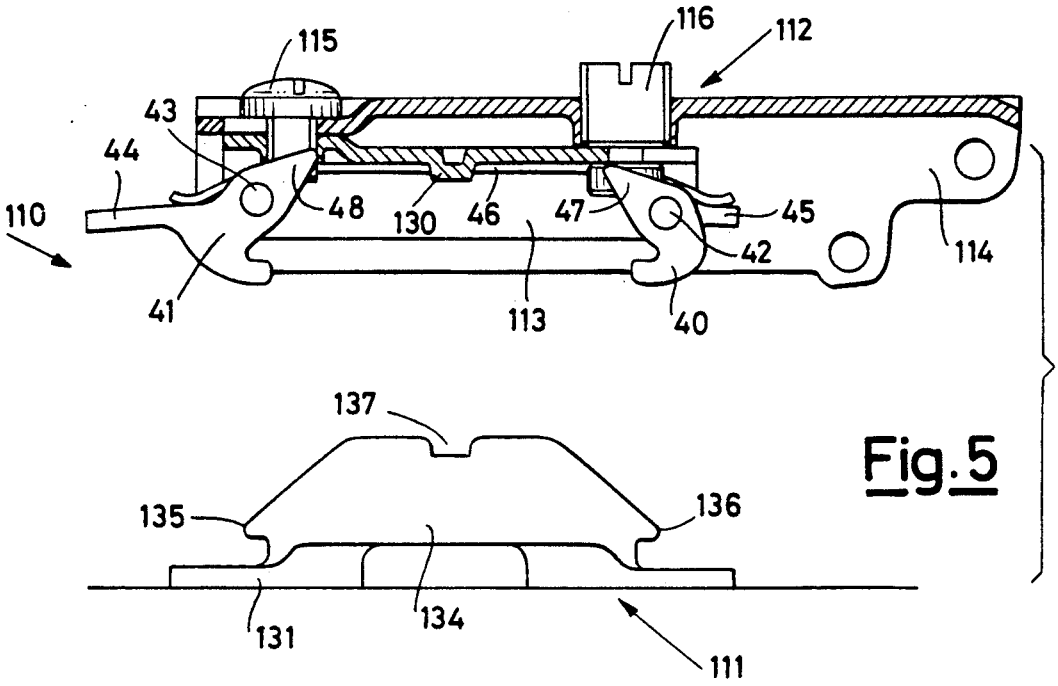
Fig.5
Fig.6
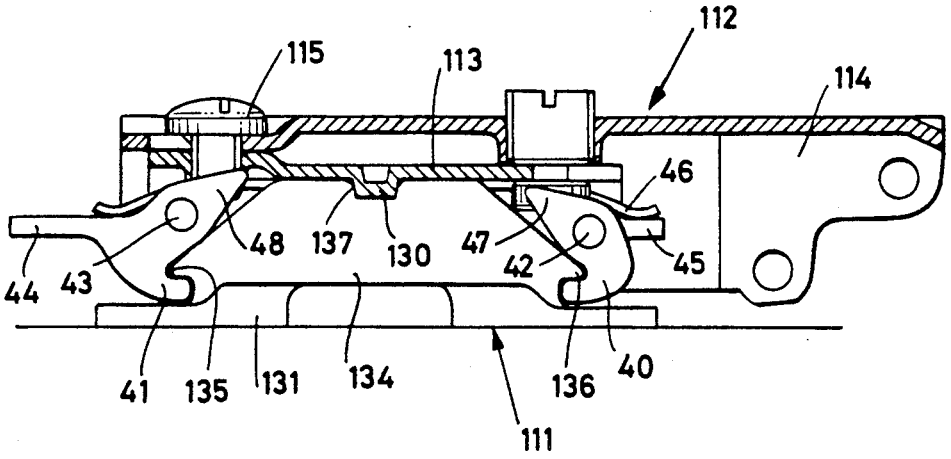

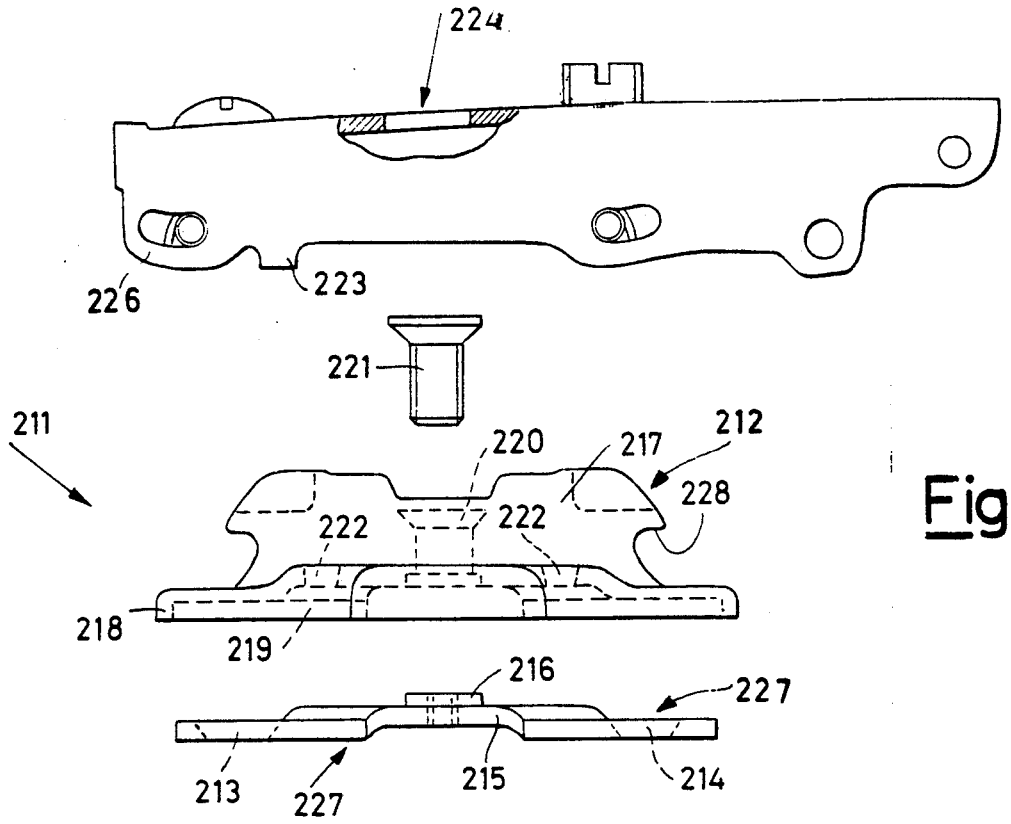
Fig.19
Fig.20
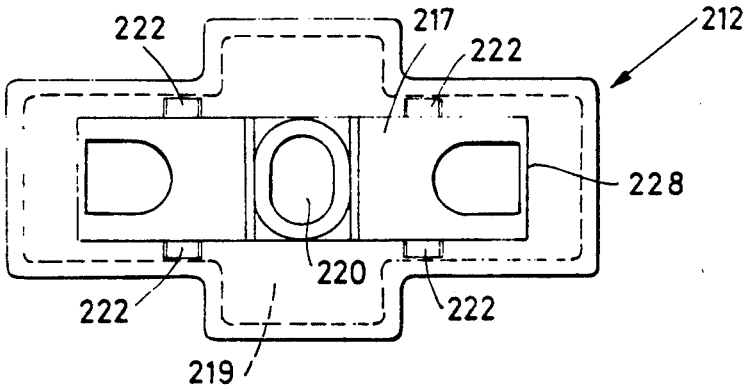
Fig.21
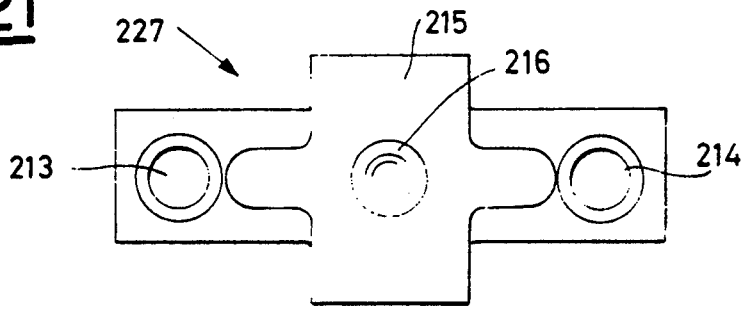

QUICK COUPLING DOOR HINGE

BACKGROUND OF THE INVENTION

This invention relates to improved furniture hinges of the type composed of two individually securable portions; the first on the door carrying the articulated joint of the hinge, ending in a free wing; the second, composed of a base secured to the piece of furniture. The two portions being connectable to each other, once secured in place, by means of suitable coupling means.

In the known technique these coupling means are made in the form of screw couplings, which consequently require tools for securing them, or are made with snap-on couplings to achieve a more rapid connection.

Even though the snap-on coupling is a solution to the problem of achieving rapid coupling and uncoupling of the parts, in the embodiments of known technique applying such solutions in order to achieve the coupling it is necessary to follow well-defined procedures to fit the parts together, and the fitter is consequently obliged to acquire a certain amount of manual dexterity in order to carry out the fitting rapidly. Moreover, the fact of having to carry out very precise combined rotational and translational movements with the door makes it necessary, in the event of more that one hinge on the same door, to simultaneously couple all the parts of them, because if one or two hinges were to be secured in place it would obviously then be impossible to carry out the movements necessary for coupling the remaining hinges.

This makes it very difficult to fit doors of very large dimensions and/or with a large number of hinges.

The scope of this invention is to obviate the aforementioned problems by providing a hinge of the type composed of two separate parts, to be secured to a door and to the corresponding rabbet of the piece of furniture, which can be quickly coupled without the need for tools and with which it is possible to couple one hinge at a time even in the event of a plurality of hinges on the door using completely indeterminate fitting movements.

A further object of this invention is also to offer the possibility of crosswise adjustment of the position of the installed hinge.

SUMMARY OF THE INVENTION

These object are achieved by providing a furniture door hinge, according to this invention, of the type in which a wing is designed to be connected to base secured to the piece of furniture, the wing having a substantially U-shaped cross-sectional configuration, to form two lateral walls which laterally embrace an intermediate element connecting the wing to the base, also having a substantially U-shaped cross-sectional configuration to form two rigid sides which laterally embrace the base, characterized by the fact that the intermediate element is provided with fastening means for securing it to the wing, and unfastenable means connecting it to the base comprising members yielding fitted onto the intermediate element in two portions spaced apart from each other in the longitudinal direction of the wing, elastically biased to move into a position in which they engage with complementary housings in the base in order to couple the intermediate element to the latter, the yielding members fitted in at least one of the two positions longitudinally spaced apart from each other being provided with a portion which can be gripped in order to force the yielding member to disengage from the housing in the base, complementary supporting surfaces being provided between the intermediate element and the base which determine the reciprocal longitudinal position, the transversal position being determined by said two rigid sides.

According to a further feature of the aforementioned hinge, said base comprises a first portion provided from above with said complementary housings and from below with a slot shaped to receive a second portion, provided with through holes for screws for securing it to the piece of furniture, said slot being shaped to enable a sliding movement of said first portion on said second portion parallel to the securing surface and perpendicular to the length of the hinge, said first portion centrally comprising a through hole, oval in said direction of movement, through which passes the shank of a securing and adjusting screw which screws into a corresponding hole in said second element.

The principles of this invention and its advantages with respect to the known technique will be more clearly evident from the following description of possible exemplary embodiments applying such principles, with reference to the accompanying drawings, in which:

FIG. 1 shows a schematic exploded sectional cutaway view of a first embodiment of a hinge of this invention.

FIG. 2 shows a partial cutaway view of the two parts of FIG. 1 coupled together;

FIG. 5 shows a schematic exploded sectional cutaway view of a second embodiment of a hinge of this invention FIG. 6 shows a partial cutaway view of the two parts of FIG. 5 coupled together;

FIG. 19 shows an exploded side elevation view of a further embodiment of the hinges according to the invention;

FIG. 20 shows a plan view of a first element of the embodiment of FIG. 19;

FIG. 21 shows a plan view of a second element of the embodiment of FIG. 19.

DETAILED DESCRIPTION OF THE INVENTION

Figure 3:
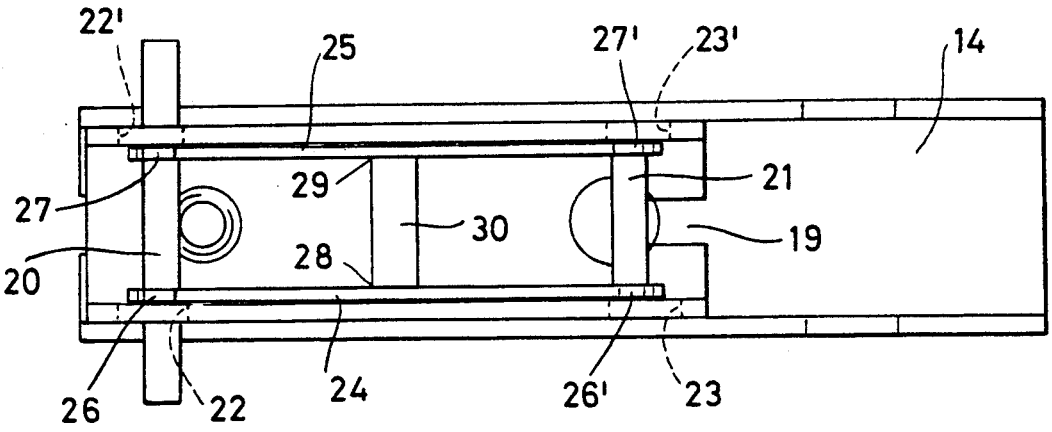
FIG. 3 shows a sectional bottom view of the first of the two parts shown in FIG. 1.

With reference to the figures, a first embodiment of a hinge generally indicated by reference 10 in FIG. 1, according to the invention, comprises a first portion or base 11 and a second portion 12 which in turn is composed of a coupling body 13 and an articulated joint wing 14 both of which are generically shaped in the form of an overturned "U".

The free end of the wing 14 is hinged, by a system known to experts in the field (and consequently neither shown nor further described), onto a plate (not shown, since it is also made according to the known technique) to be secured to a door of a piece of furniture.

The wing 14 and the coupling body 13 are interconnected by means of a first securing and adjusting screw 15 screwed into an appropriate hole in the body 13 and a second adjusting screw 16 screwed into an appropriate hole in the body 14.

The shank of the screw 15 passes through a slit 17, provided in the the body 14 and extending in the direction of its major axis, and with its head prevents the detachment of the body 13 from the wing 14.

The second screw 16 is suitably shaped from below with a groove 18 so as to fit slidingly into a second slit 19.

In this way the screws 15 and 16 cooperate to ensure only one possiblity of reciprocal sliding of the body 13 and the wing 14 parallel to their major axis.

The body 13 is internally provided with two pin rollers 20 and 21, respectively, extending between its two vertical walls and supported in shaped guide slits 22, 22' and 23, 23' respectively, also shown in FIG. 3 by the broken lines.

The pin 20 has ends protruding and shaped so as to enable it to be operated, as will be explained further on.

Said guide slits ensure that the rollers 20 and 21 slide in a direction perpendicular to their axis and substantially parallel to the major axis of the body 13.

Two arched springs 24 and 25, for example made of steel piano wire, are disposed between the two pins 20 and 21 so that their ends press into grooves 26, 26' and 27, 27', respectively, made around the circumference of the pins.

The medial portions of the two springs 24, 25 are then inserted into grooves 28, 29 respectively, made in a raised portion 30 disposed in the center of the body 13.

The springs thus bias the two pins towards each other and then at the end of the slits 22, 23 towards the interior of the body 13.

Moreover, the presence of the springs in the grooves in the pins prevents the pins from accidenta ly slipping out of the guide slits 22, 23.

Figure 4:
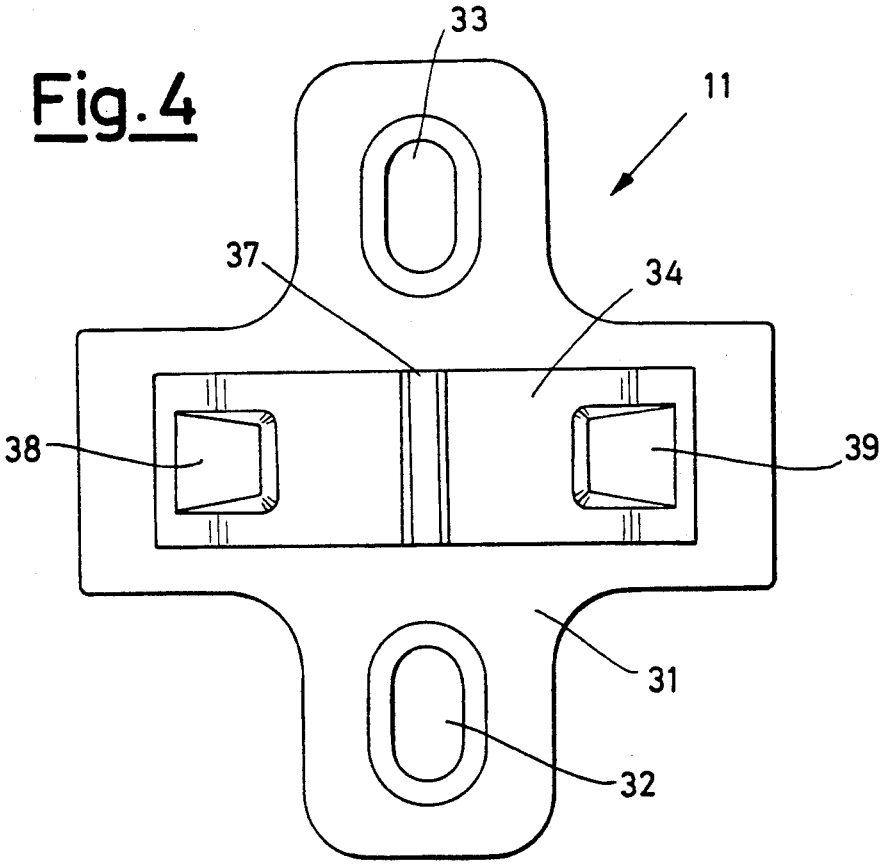
FIG. 4 shows a plan view of the second of the two parts of FIG. 1.

As can be seen in FIGS. 1 and 4, the base 11 comprises a plate 31, for securing it to the piece of furniture, having securing holes 32, 33 and a coupling shape 34 with teeth 35 and 36 with sloping upper surfaces, a groove 37 complementary to the step 30 and recesses 38, 39 (also shown, by the broken line, in FIG. 1).

As can be seen in FIG. 2, the pins, together with the springs 24 and 25, constitute means for coupling the body 13 to the base 11 by cooperating with the protruding teeth 35, 36 of the latter. For this reason, the lower shapes of the protruding teeth and the diameters of the rollers must be made in such a way as to prevent them from accidentally uncoupling when subjected to traction perpendicular to the securing surface of the base.

The hinge described above operates in the following way.

The base 11 and the articulated portion (not shown in the figures) connected to the wing 14 are secured to the piece of furniture and to the door, respectively, according to known methods which are easily imaginable by anyone expert in the field.

In order to connect the base to the corresponding coupling body, it is sufficient to fit them together and press them against each other until the coupling means on the body engage under the protruding teeth on the base.

During the pressing phase the rollers 20 and 21 slide over the sloping upper surfaces of the teeth 35 and 36, against the reaction of the springs 24 and 25, until they fit into place beneath said teeth, as shown in FIG. 2, thus locking the body to the base. In this condition, the step 30 engages in the groove 37 thereby preventing any horizontal sliding movements, as shown in FIG. 2.

As can be seen in FIG. 2, the recesses 38, 39 receive the inward protruding portions of the screws 15 and 16. Once the two parts of the hinge have been coupled together, it is possible to carry out the fine adjustment of the position of the door with respect to the rabbet on the piece of furniture by sliding the wing 14 along the body 13 and tightening the screw in order to lock it in the desired position and then turn the screw 16 in order to adjust the "lift" of the wing with respect to the body 13.

Whenever it is necessary to uncouple the two parts, for example, in order to detach the door from the piece of furniture, it is sufficient to grip the ends of the rollers protruding from the body 13 and slide the pin 20 along the guides 22, so as to disengage it from under the protrusion 35. It is then possible, by means of a simple translational movement, to disengage the second pin, thus completely separating the two parts of the hinge. On the contrary, if only one of the ends of a roller is accidentally pressed, this is not sufficient to uncouple the parts and consequently detach the door.

Although it is sufficient for the configurations of the teeth 35, 36 to be made in such a way as to have, for the coupling, and angle between the lower part of the tooth and the axis of the pin guide slits smaller that the angle of static friction between the pin and the tooth, these configurations can advantageously be made, for the uncoupling, in such a way that, after rotation of the body 13 around the pin 21 which is made possible by disengagement of the pin 20, the aforementioned angle becomes larger that the angle of friction so as to enable the disengagement of the pin 21 simply by means of traction perpendicular to the wing 14 without the need for further translation in other directions.

A second embodiment of a hinge applying the principles of this invention, is generally indicated by reference 110 in FIG. 5 and comprises a first portion or base 111 and a second portion 112, in turn composed of a coupling body 113 and an articulated joint wing 114 both of which are generically shaped in the form of an overturned "U".

The wing 114 is similar to the wing 14 of FIG. 1 and carries an identical articulated joint of known technique (and consequently not shown). Said wing is connected to the body 113 by means of a first securing and adjusting screw 115, screwed into an appropriate hole in the body 113, and a second adjusting screw 116 screwed into an appropriate hole in the body 114 in the same way as for the wing 14 and the body 13 by means of screws 15 and 16.

Figure 7:
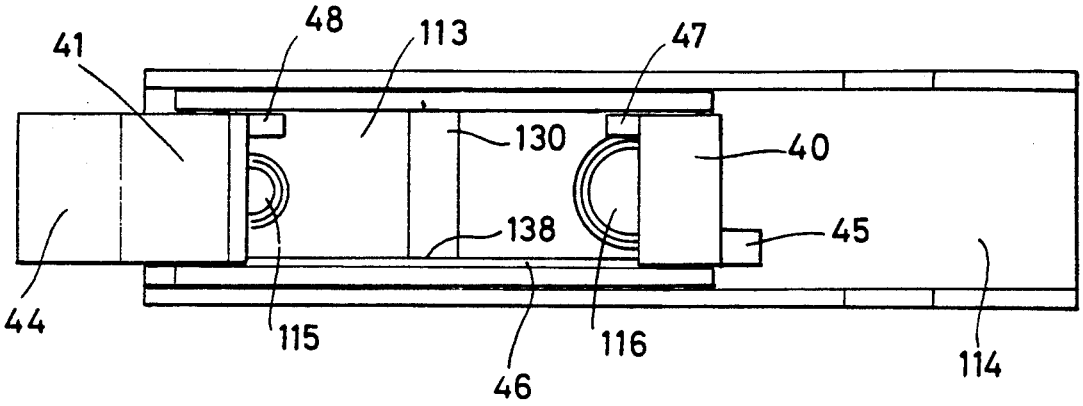
FIG. 7 shows a sectional bottom view of the first of the two parts shown in FIG. 5.

As can be clearly seen in FIGS. 5 and 7, the upturned "U"-shaped body 113 is internally provided with two hooks 40 and 41, which are movable around their respective pins 42 and 43 disposed between the lateral walls of the body 113.

The interior of the body 113 is also provided with a centrally-disposed raised portion 130.

The hook 41 has an operating extension 44 protruding from the near end of the body 113.

The hook 40 is provided on one side with a protrusion 45 onto which is engaged an arched spring 46, for example made of steel piano wire, with the other end engaged on the extension 44 of the hook 41 and the central portion fitting into a notch 138 in the raised portion 130. In this way, the spring 46 offers opposition to the rotation of the hooks towards the outside of the body 113. The two hooks 40, 41 are provided on the opposite side with stop protrusions 47, 48 respectively, which by touching upper internal surfaces of the body 11, limit the inward rotation of the hooks. Both the hooks are provided on their upper portions with suitable reliefs, which are not shown in the figures, to enable them to fit in place without interfering with the screws 115, 116.

Figure 8:
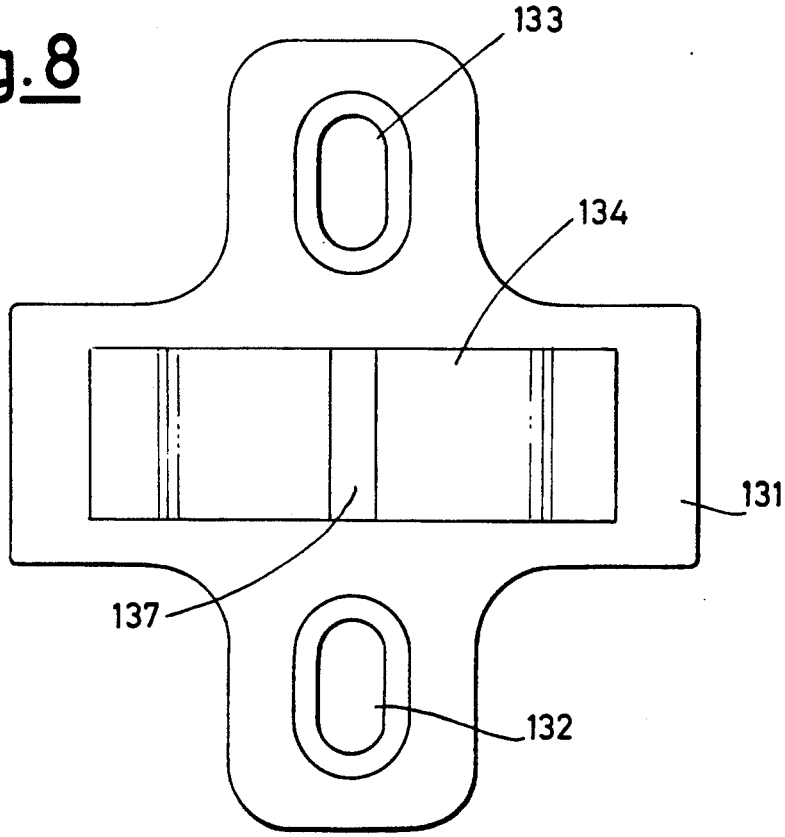
FIG. 8 shows a plan view of the second of the two parts of FIG. 5.

As can be seen in FIGS. 5 and 8, the base 111 comprises a plate 131 for securing it to the piece of furniture, having securing holes 132, 133, and a coupling shape 134 with teeth 135 and 136 with sloping upper surfaces and a groove 137 complementary to the step 130.

As can be seen in FIG. 6, the hooks 40, 41, together with the spring 46, constitute means for coupling the body 113 to the base 111 by cooperating with the protruding teeth 135, 136 of the latter. For this reason, the shapes must be made in such a way as to prevent them from being accidentally uncoupled by traction perpendicular to the securing surface of the base.

The hinge described above operates in the following way.

After having secured the base 111 to the piece of furniture, and the articulated hinge (not shown) ending with the wing 114 to the door, it is sufficient to fit the base 111 onto the body 113 and press them together.

During the pressing phase the hooks 40 and 41 slide over the sloping upper surfaces of the teeth 135 and 136, against the reaction of the spring 46, until they fit into place, as shown in FIG. 6, with their hooked end under said teeth, thus locking the body to the base. In this condition, the step 130 engages in the groove 137 thereby preventing any horizontal sliding movements, as shown in FIG. 6.

Once the two parts of the hinge have been coupled together it is possible to carry out the fine adjustment of the position of the door with respect to the rabbet on the piece of furniture, in the same way as described for the first embodiment, by means of the screws 115 and 116.

Whenever it is necessary to uncouple the two parts, for example, in order to remove the door from the piece of furniture, it is sufficient to grip the operating tab 44 of the hook 41 and shift it upwards, as shown in FIG. 6, so as to disengage the hook from under the protrusion 135 and then rotate and shift the body 113 slightly so as to also disengage the hook 40.

Figure 9:
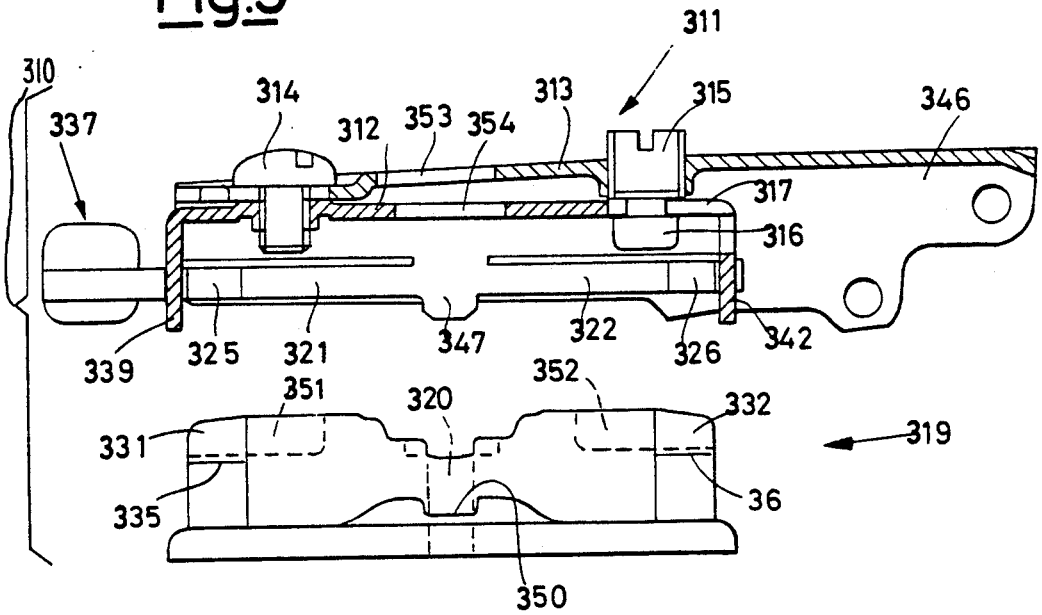
FIG. 9 shows an exploded, side elevation view, partially cut away along the line IX—IX of FIG. 10, of a third embodiment of a hinge of this invention.

A third embodiment of a hinge applying the principles of this invention is generally indicated by reference 310 in FIG. 9 and comprises a first portion 311 composed of a coupling body 312 and an articulated joint wing 313 both of which are generically shaped in the form or an overturned "U" and connected to each other by means of a reciprocal locking and adjusting system composed of screws 314 and 315, in the same way as in the previously described embodiments.

The front free end 346 of the wing 313 is connected to an articulated joint (again not shown) with a plate for securing it to the door of a piece of furniture.

A second portion or base 319, designed to be secured to the piece of furniture, comprises a hole 320 extending crosswise to the base, which is penetrated by the shank of a screw securing the base to means for connecting it to the piece of furniture, means for example of the plate type, as will be described further on.

The base 319 is shaped to fit and snap into the body 312, as will be explained further on.

According to the invention, the coupling body 312 comprises, on one of its lateral walls, longitudinal metal strips 321, 322 leading off from the center towards the ends and faced with specular longitudinal metal strips 323, 324 on the other lateral wall.

The metal strips are elastically yieldable towards the outside of the body in a direction perpendicular to the lateral walls and can either be moulded directly onto the coupling body or inserted.

Each strip 321, 322, 323, 324 has a tooth (325, 326, 327, 328 respectively) close to the end and facing towards the inside of the body.

As can be clearly seen in FIG. 13, for teeth 326 and 328, all the teeth 325, 326, 327, 328 are tapered downwards to enable them to slide, during the coupling of the portion 311 to the base 319, over sloping surfaces 329, 330, 331, 332, respectively, disposed in an upper lateral position close to the four corners of the base 319 and ending from below in respective steps 333, 334, 335, 336.

Figure 10:
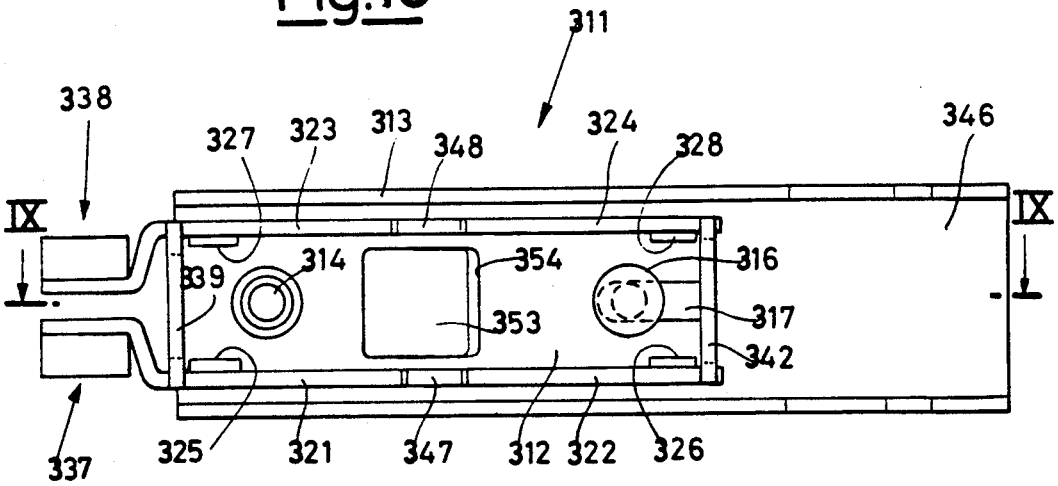
FIG. 10 shows a bottom plan view of a first part of the hinge of FIG. 9.
Figure 12:
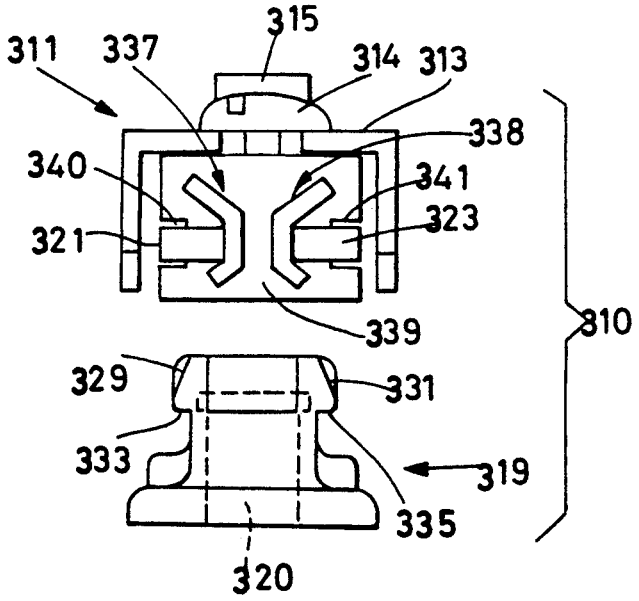
FIG. 12 shows and exploded rear elevation sectional view of the hinge of FIG. 9.

As can also be clearly seen in FIGS. 10 and 12, the free ends of the strips 321 and 323 pass through a rear closing and supporting wall 339 of the body 312 by means of lateral apertures 340 and 341, respectively, in said wall, ending just outside the portion 311 with shaped ends 337, 338.

Figure 13:
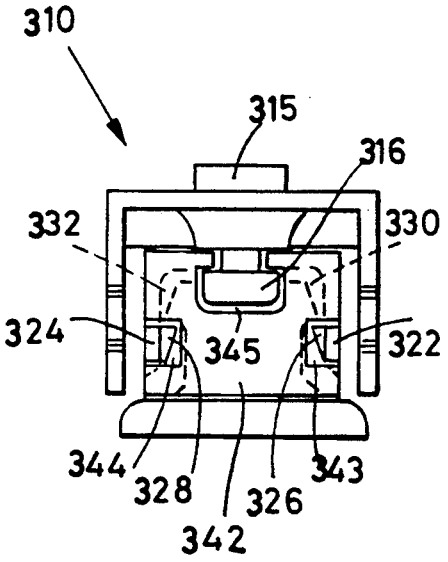
FIG. 13 shows a front elevational sectional view of the hinge of FIG. 9.

As can also be seen in FIG. 13, the free ends of the strips 322 and 324 pass through a front closing and supporting wall 342 of the body 312 by means of lateral apertures 343 and 344, respectively, in said wall, ending just outside the latter.

In this way, even though the strips 321, 322, 323, 324 are flexibly movable towards the outside of the body 312, they are supported by the passages through the respective front and rear walls of the body, thus preventing any possible movements parallel to the lateral walls.

As can be clearly seen in FIGS. 13, the front wall 342 has a notch 345 shaped like the foot 316 of the screw 315, so as to enable it to fit into the slot 317 when the hinge is made.

Figure 11:
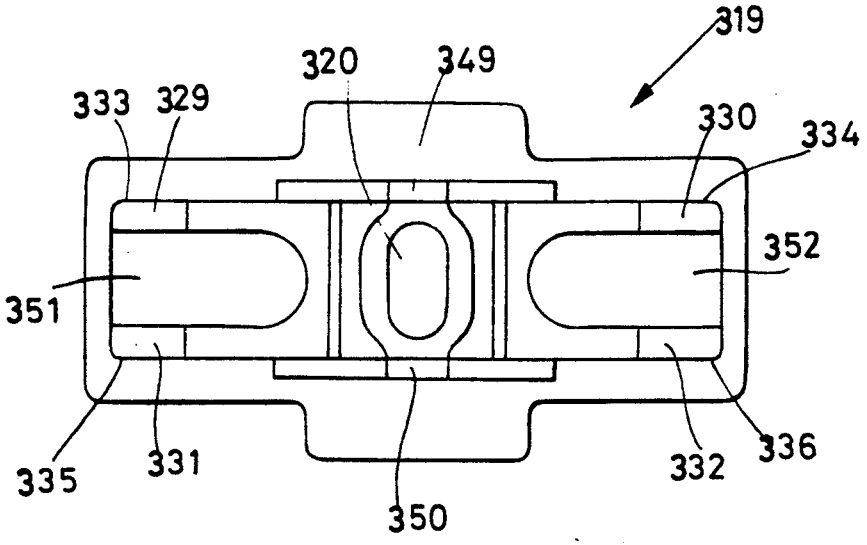
FIG. 11 shows a top plan view of a second part of the hinge of FIG. 9.

Two teeth 347, 348 extend downwards from the lateral walls of the body 312 and fit into respective housings 349 and 350 (as shown in FIG. 11) on the sides of the base 319, thus preventing, during the coupling, any possible longitudinal sliding between the base and the coupling body 312.

The base 319 is also provided with slots 351 and 352 to receive the lower ends of the screws 314 and 315, respectively.

Lastly, the wing 313 and the body 312 are provided on their upper surfaces with passages 353 and 354 enable the securing screw which is inserted in the hole 320 in the base to pass through them.

The base is advantageously made symmetrical so that the longitudinal orientation is not restricted.

The above described hinge operates in the following way.

The bases 319 are secured to the piece of furniture and the articulated elements, ending with the parts 311, are secured to the door and then each part 311 is fitted onto its respective base 319 with a movement which does not call for any particular inclination of the coupling parts.

It is sufficient to slide the sloping portions of the teeth disposed on the strips 321, 322, 323, 324 (which bend flexibly towards the outside of the hinge) over the sloping portions 329, 330, 331, 332, respectively, of the base, until they each snap into place under the terminal step of the latter.

In this way, however many hinges there are on the side of the door, they can be connected to their respective bases one at a time, without having to maneuver the door, by simply exerting pressure on the upper part of the wing in a direction substantially perpendicular to the securing surface of the base.

It is then possible, by means of the known technique, to adjust the striking positions of the door by turning the adjusting screws 314, 315.

Whenever it is necessary to uncouple the hinges in order to remove the door from the piece of furniture, it is sufficient to separate the shaped ends 337, 338 (for example, by prying them apart with a screwdriver), so as to shift the teeth 325, 327 from under the steps 333, 335 and then slightly raise the rear end of the part 311 so as to be able to disengage the teeth 326 and 328 from their respective steps 334, 336 by shifting them in the direction of the articulated joint, as is easily imaginable.

It should be noted that, because of to the complete independence of the strips on either side of the hinge, when only one of the ends 337 or 338 is shifted it is not sufficient to separate the base 319 and the part 311, thus offering further assurance against the danger of accidental uncoupling.

A further application of the principles of the invention is given in the following description, with reference to FIGS. 14 to 18, of a fourth embodiment of the hinge with snap-on coupling in which the parts are fitted together in a non strictly predetermined direction.

Figure 14:
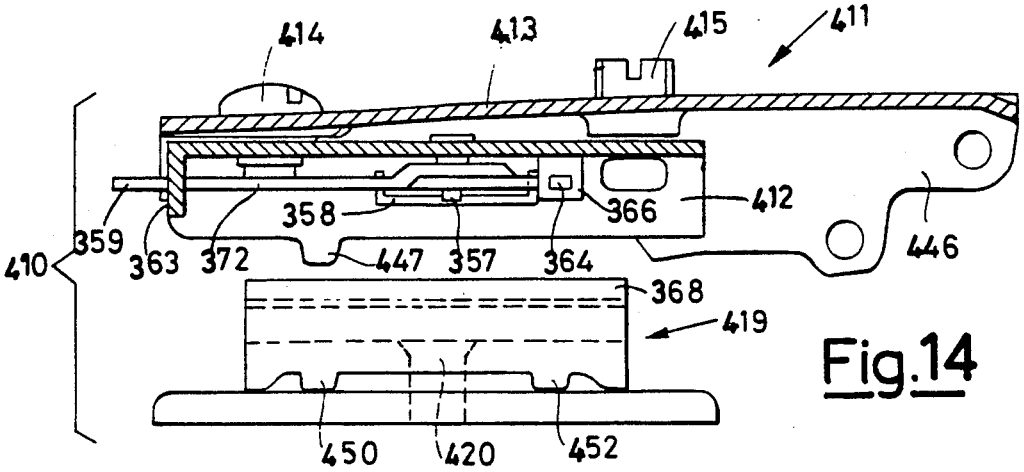
FIG. 14 shows an exploded side elevation view, partially cut away along the line XIV—XIV of FIG. 15, of a fourth embodiment of this invention.

As can be seen in FIG. 14, said fourth embodiment, which is generally indicated by reference 410, comprises, as in the previous description, a first portion 411 composed of a coupling body 412 and an articulated joint wing 413 (with the end 446 connected to an articulated joint of known technique securable to the door of a piece of furniture) both of which are generically shaped in the form of an overturned "U" and connected to each other by means of a reciprocal locking and adjusting system, of known technique, composed of screws 414 and 415.

A second portion or base 419, designed to be secured to the piece of furniture, has a hole 420 extending crosswise to the base, which is penetrated by the shank of a screw for securing the base.

The base 419 is shaped to fit and to snap into the body 412, as will be explained further on.

Figure 15:
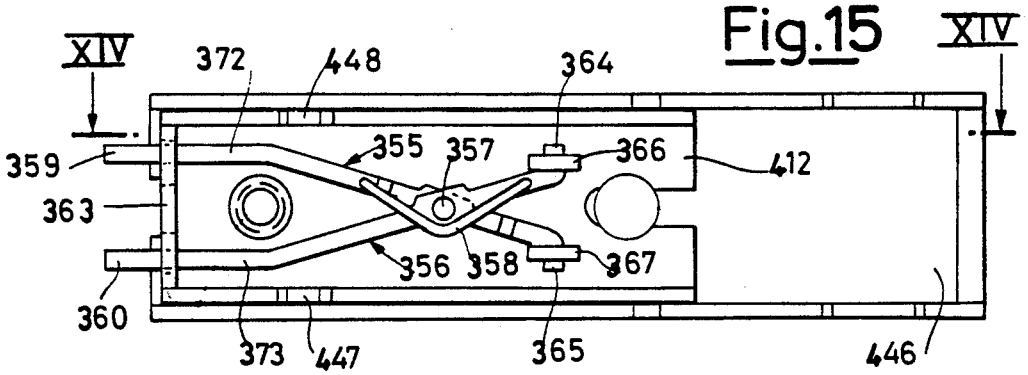
FIG. 15 shows a bottom plan view of a first part of the hinge of FIG. 14.

According to the invention, as can be clearly seen in FIG. 15, the coupling body 412 comprises two elements 355 and 356 connected "scissorwise" by means of a pin 357, secured in a substantially central position to the upper parts of the body 412, and held open by means of a wire spring 358.

The elements 355 and 356 have ends 359 and 360, respectively, protruding towards the outside, at the rear of the body 412, through slits 361 and 362 made in a rear supporting wall 363 enabling said ends 359, 360 to be moved towards each other manually.

The opposite ends of the elements 355 and 356 are bent towards the lateral walls of the body 412 to form couplings 364 and 365 which fit, in a sliding and protruding manner, into supports 366 and 367 integral with the body 412.

In this way, the elements 355, 356 have ends which can move in a plane parallel to the upper surface of the body 412, but cannot move in a direction perpendicular to the latter since they are supported from the rear by the wall 363 and from the front by the supports 366 and 367.

The base 419 has upper coupling branches or arms 368 and 369 which, during the coupling between the base 419 and the part 411, fit in between the elements 355, 356 and the internal lateral walls of the body 412. The branches 368 and 369 have sloping surfaces 370 and 371, respectively, over which the ends 364, 365 and the sections 372, 373 slide until they fit into horizontal grooves 374, 375, as can be seen in FIGS. 17 and 18.

Two coupling teeth 447, 448 extend downwards from the lateral walls of the body 412 and fit into respective housings 449, 450 or 451, 452 (depending upon the longitudinal orientation of the base, which is advantageously made symmetrical with respect to a median plane crosswise to the hinge), so as to prevent any possible longitudinal sliding between the base and the coupling body 412 during the coupling.

Figure 17:
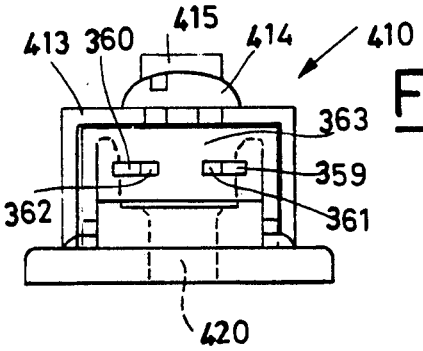
FIG. 17 shows a rear elevation sectional view of the hinge of FIG. 14.
Figure 16:
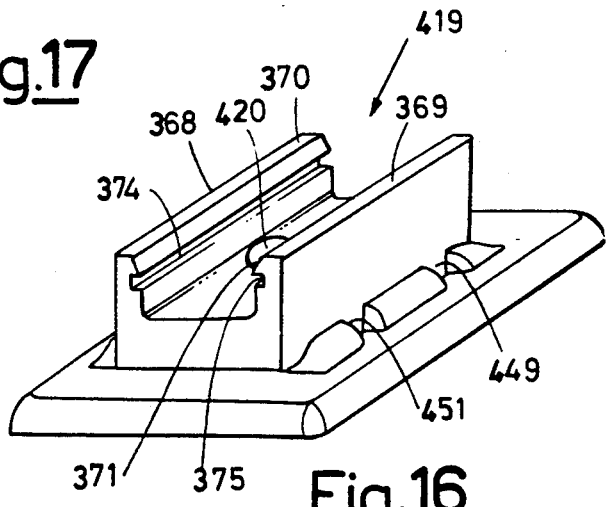
FIG. 16 shows a perspective view of a second part of the hinge of FIG. 14.
Figure 18:
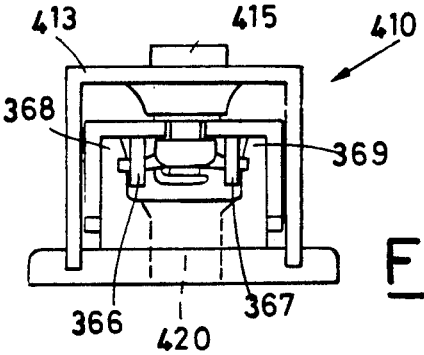
FIG. 18 shows a front elevation sectional view of the hinge of FIG. 14.

To use the hinge 410, the bases 419 are secured to the piece of furniture and the articulated elements, ending with the parts 411, are secured to the door and then each part 411 is fitted onto its respective base 419 with a movement which does not call for any particular inclination of the coupling parts, since it is sufficient to slide the ends 364, 365 and the sections 372, 373 of the scissor elements 355, 356 (which close against the action of the spring) over the sloping surfaces 370, 371 of the branches 368, 369 until they snap into place in the grooves 374, 375 (as shown in FIGS. 17 and 18), so as to firmly connect the parts of the hinge.

In this way, however many hinges there are on the side of the door, they can be connected to their respective bases one at a time, without having to maneuver the door, by simply exerting pressure on the upper part of the wing in a direction substantially perpendicular to the securing surface of the base.

It is then possible, by means of the known technique, to ajust the striking positions of the door by turning the adjusting screws 414, 415.

Whenever it is necessary to uncouple the hinges in order to remove the door from the piece of furniture, it is sufficient to bring the protruding ends 359, 360 together, so as to disengage the elements 355, 356 from the grooves 374, 375. In this way the upper part 11 can be detached from the base according to any inclination which, advantageously, can also be that in which the hinge is coupled to the base.

The fact that the couplings of the scissor elements in the base are in independent pairs ensures that if only one end 359 or 360 is accidentally moved it is not sufficient to detach the coupling body from the base, thus offering further assurance against accidental uncoupling.

According to the principles of this invention, the embodiments described above offer the advantage that, once the two parts have been fitted onto the piece of furniture and the door, no complicated and well-defined maneuver are necessary to couple the parts, as occurs in hinges of known technique. In order to connect them firmly together, the reciprocal movement between the base and the coupling body can be extremely varied; for example, it may be decided to first couple one side of the hinge and then the other, starting either from the rear side or from the front side. Moreover, being able to make use, among this variety of possible approaches, of a coupling movement perpendicular to the securing surface of the base makes it possible, as can easily be imagined, to couple the hinges of one door, one after the other, in any order whatsoever, without difficulty, however many of them there are.

The base bodies 34, 134, 319, 419 can advantageously be made of cast metal, while the corresponding coupling bodies can be advantageously made of appropriately shaped pressed metal.

Attention is drawn to the symmetry of the bases 34, 134, 319, 419, which enables them to be fitted quickly without having to take the front or rear orientation into consideration.

FIGS. 19 to 21 show a possible variation on the above-described hinges in order to also give them a possibility of crosswise adjustment.

For the sake of convenience, this variation is shown applied to a hinge of the type represented in FIG. 1, but is obviously also applicable, as is easily imaginable by the technician, to hinges of the type represented in FIGS. 5–18.

In order to obtain the possibility of crosswise adjustment, a base 211, to be coupled with a hinge wing 212, is made with a shaped backing plate 218 with a lower surface having a recess 219 shaped to receive an element 227.

As can be clearly seen in FIG. 21, the element 227 comprises two countersunk holes 213 and 214 to secure it, by means of screws, to the piece of furniture, and a central part 215 having a threaded hole with a raised edge 216.

As can be clearly seen in FIG. 20, the coupling block 217 (for the remainder similar to the coupling block 34) is centrally provided with a countersunk slot 220 into which is fitted a screw 221 which when screwed into the hole 216 connects the base 211 to the element 227.

The recess 219 is shaped and sized so as to receive the element 227 sliding in a crosswise direction to the length of the hinge and parallel to the securing surface of the base, due to the amplitude of movement made possible by the extended shape of the slot 220.

The wing 212 and the underlying support 226 are provided on the upper part with holes defining a passage 224 (shown in cross-section in FIG. 19) suitable for enabling the screw 221 to be turned with the wing 212 fitted in place. For this reason, prevention of axial sliding between the base and the wing of the hinge is achieved by means of lateral interlocking parts, as previously shown in FIGS. 14–18 and, similarly, (with a variation of the embodiment) in FIGS. 9–13. Said lateral interlocking parts consequently comprise upper recesses 222 made in the plate 218 which fit onto corresponding locking teeth 223 protruding from the body 226.

At the moment of use, the element 227 is secured to the piece of furniture by means of screws passing through the holes 213 and 214, the element 212 is secured to it by means of the screw 221, the wing of the hinge is fitted onto the body 217 and their vertical position is adjusted, with respect to the element 227 secured to the piece of furniture, thanks to the clearance between the element 227 and the recess 219. After the desired vertical position has been reached, the screw 221 is tightened through the passage 224 so as to make the wing integral with the piece of furniture.

As mentioned previously, the application of this variation to all the types of hinges described above is easily imaginable by the technician. Only in the case of the hinge shown in FIGS. 14–18 is it not possible to obtain passages for turning the screw to adjust the crosswise position once the hinge is coupled, due to the presence of the scissor elements.

However, by using a base as described in FIGS. 19–21 it is possible to obtain a reliable fastening, without unsightly screws that show on the base while at the same time advantageously enabling the hinge to be adjusted vertically.

The element 227 can advantageously be made of plastic. The embodiments described above are, obviously, given purely by way of example in order to illustrate the principles of this invention and should consequently not be understood as a limitation to the scope of the invention claimed herein.

In particular, the shape of the bases can be varied for example in order to achieve different systems for securing them to the piece of furniture. It is, in fact, easy to deduce that the configuration of the lower part of each base described can be modified according to that shown in the others. For example, the bases 319, 419 can be made with perforated lateral wings to enable them to be screwed on directly as shown in the first two embodiments or with a lower recess in order to use a base plate as shown in FIG. 21.

Moreover, the securing and adjusting system disposed between the wing and the coupling body can be of any known type and even be replaced by a fixed locking system if it is not considered necessary, for a given use, to be able to carry out the fine adjustment of the closing position of the door.

The scissor elements 355 and 356, instead of being thin portions extending in a plane substantially parallel to the upper surface of the wing can, obviously, also be larger elements, for example, extending in planes parallel to the lateral walls of the wing, so as to make them sturdier.

It should be noted that although the uncoupling method of the first embodiment enables only one of the two rollers to be operated directly in order to uncouple the hinge, there is nothing to prevent an uncoupling procedure being devised, whereby both pins are operated, by also providing the ends of the pin 21 with gripping protrusions.

As can be easily imagined by the technician, the element 227 can be shaped differently, as can the corresponding recess 219. The means for preventing slippage between the base and the coupling body, instead of with the recesses 222 and teeth 223, can be made differently, for example with teeth on the base fitting into corresponding recesses in the body 226 or with recesses and protrusions on the upper part of the coupling block and on the body 226 in a way similar to that shown in FIGS. 1 and 5, but disposed in a lateral position with respect to the securing screw 221.

We claim:

1. A furniture door hinge comprising a base plate having a raised portion to be secured to a piece of furniture, a hinge arm adapted to support a furniture door and an intermediate element or removably connecting the arm to the base, said arm having a substantially U-shaped cross-sectional configuration forming two lateral side walls which laterally embrace the intermediate element and said intermediate element having a substantially U-shaped cross-sectional configuration forming two lateral side walls that embrace two lateral side surfaces on the raised portion of the base plate, means for fastening the arm to the intermediate element and readily releasable fastening means for coupling the intermediate element to the base, said releasable fastening means comprising a pair of members yieldably mounted in said intermediate element at spaced apart locations in the longitudinal direction of the side walls of the element for movement between a disengaged position and an engaged position where the element is coupled to the base, spring means biasing the members toward the engaged portion, a pair of opposed protrusions at opposite ends of the raised portion of said base plate, said protrusions forming housings for receiving said members in the engaged position and having a slanting upper surface that slants inwardly and upwardly from the ends of the protrusions, whereby as the intermediate element is pressed down onto the base plate in a direction substantially perpendicular to the base plate, with its side walls embracing the sides of the raised portion of the base plate, the slanted upper surfaces of the protrusions will push the yielding members against the action of the spring means toward the disengaged position until they pass the ends of the protrusions and come to rest in the housings, at least one of said yielding members having a portion that can be manually gripped to force it from its housing in the base plate toward its disengaged position to permit the intermediate element and attached arm to be removed from the base plate,

2. The hinge of claim 1, wherein said protrusions face outwardly and said yielding members comprise a pair of parallel rollers with their ends slidably mounted in guide slots in the side walls of the intermediate element, said slots being shaped to guide the movement of each roller in a direction perpendicular to its own axis between its disengaged position where the rollers are away from each other and its engaged position, at least one of said rollers having an end extending beyond the outside of said side walls of the arm and element to provide said gripable portion.

3. The hinge of claim 2, wherein the spring means are a plurality of arched springs, each having both ends disposed in symmetrical grooves in each of the two rollers and its intermediate portion secured to said intermediate element so as to bias the two rollers towards each other.

4. The hinge of claim 1, wherein the yielding members comprise a pair of hooks pivotally mounted to the side walls of the intermediate element and engaging under said protrusions in the raised portion of the base plate in the engaged position.

5. The hinge of claim 4, wherein at least one of said hooks has an extension protruding outside of the hinge to provide said grippable portion.

6. The hinge of claim 1, wherein the means for fastening the arm to the intermediate element is adjustable for varying their relative position longitudinally and in a direction perpendicular to the base plate.

7. The hinge of claim 1, wherein said base plate comprises a first portion having on its upper surface said raised portion and the housings for said yielding members and having a recess on its lower surface shaped to receive a second portion provided with through holes for securing it to the piece of furniture, said recess being shaped to enable said first portion to slide onto said second portion in a direction parallel to the base plate and perpendicular to the longitudinal length of the hinge arm, said first portion having a through hole in a central position that is oval in shape in said direction of movement through which passes an adjusting screw that engages with a corresponding hole in said second portion.

8. A furniture door hinge comprising a base plate having a raised portion to be secured to a piece of furnitue, a hinge arm adapted to support a furniture door and an intermediate element for removably connecting the arm to the base, said arm having a substantially U-shaped cross-sectional configuration forming two lateral side walls which laterally embrace the intermediate element and said intermediate element having a substantially U-shaped cross-sectional configuration forming two lateral side walls that embrace two lateral side surfaces on the raised portion of the base plate, means for fastening the arm to the intermediate element and readily releasable fastening means for coupling the intermediate element to the base, said releasable fastening means comprising at least two first coupling elements mounted in said intermediate element at spaced apart locations for movement between a disengaged position and an engaged position where the intermediate element is coupled to the base, spring means biasing the coupling elements into the engaged position, at least two complementary housings located in opposed lateral side surfaces of the raised portion of the base for receiving said coupling elements in the engaged position to thereby couple the intermediate element and attached arm to the base, each of said coupling elements having a portion extending exterior of the intermediate element that can be simultaneously gripped to move said coupling elements to their disengaged position so that the intermediate element and attached arm can be removed from the base plate.

9. The hinge of claim 8, including two additional coupling elements with associated spring means mounted in said intermediate element and engageable with complementary housings in the lateral side surfaces of the base which can be disengaged when the first two coupling elements are disengaged.

10. The hinge of claim 9, wherein the two additional coupling elements are both operatively connected to the first coupling elements.

11. The hinge of claim 9, wherein the two additional coupling elements can be disengaged after the first coupling elements are disengaged by inclination of the intermediate element and attached arm with respect to the base.

12. The hinge of claim 8, wherein the two first coupling elements from part of the lateral side walls of the intermediate element each being a longitudinal strip elastically yieldable in a direction perpendicular to said side walls and having a tooth facing inwardly which fits into a complementary lateral recess in the raised portion of the base, each tooth being tapered towards the direction of coupling between the base and the intermediate element so that it slides over a corresponding sloping surface on the base adjacent each recess to facilitate engagement between the tooth and the recess as the intermediate element and attached arm is pressed down onto the base plate in a direction substantially perpendicular to the base.

13. The hinge of claim 12, wherein the portions of the strips extending exterior of the intermediate element pass through apertures in the element running substantially perpendicular to the direction of engagement between the coupling strips and the base.

14. The hinge of claim 8, wherein the coupling elements are connected in a cross scissor manner pivoted on a fixed pivot in a substantially central position of the intermediate element, and are held apart by means of a spring disposed between them, the elements having operating extensions protruding from the rear part of the intermediate element to provide said gripable portions, whereby the elements are pushed into their respective housings in the base during the coupling of the intermediate element with the base under the action of the spring and are simultaneously released from the latter when the operating extensions are brought together.

15. The hinge of claim 14, wherein the raised portion of the base plate comprises two spaced laterally extending walls and the housings for the coupling elements are grooves running parallel to the length of the walls that are disposed facing each other on the inside surfaces of the walls, the upper end of said walls being tapered for guiding the coupling elements into their respective grooves during coupling of the intermediate element to the base.

16. The hinge of claim 8, wherein the means for fastening the arm to the intermediate element is adjustable for varying their relative position longitudinally and in a direction perpendicular to the base plate.

17. The hinge of claim 16, wherein the adjusting screw can be engaged through an opening provided in the arm and in the intermediate element.

18. The hinge of claim 8, wherein said base plate comprises a first portion having on its upper surface said raised portion and the housings for said yielding members and having a recess on its lower surface shaped to receive a second portion provided with through holes for securing it to the piece of furniture, said recess being shaped to enable said first portion to slide onto said second portion in a direction parallel to the base plate and perpendicular to the longitudinal lengh of the hinge arm, said first portion having a through hole in a central position that is oval in shape in said direction of movement through which passes an adjusting screw that engages with a corresponding hole in said second portion.

19. The hinge of claim 17, wherein the adjusting screw can be engaged through an opening provided in the arm and in the intermediate element.

* * * * *